United States Patent [19]

Bauer

[11] Patent Number: 4,613,081

[45] Date of Patent: Sep. 23, 1986

[54] INJECTION VALVE FOR AN INTERNAL COMBUSTION ENGINE

[75] Inventor: Philippe Bauer, Marly le Roi, France

[73] Assignee: Societe Industrielle de Brevets et d'Etudes (S.I.B.E.), France

[21] Appl. No.: 662,074

[22] Filed: Oct. 18, 1984

[30] Foreign Application Priority Data

Oct. 20, 1983 [FR] France ..... 83 16712

[51] Int. Cl.[4] ..... F02M 69/04

[52] U.S. Cl. ..... 239/585; 239/533.12

[58] Field of Search ..... 239/124, 125, 533.12, 239/574, 585

[56] References Cited

U.S. PATENT DOCUMENTS

| | | | |
|---|---|---|---|
| 2,921,746 | 1/1960 | Burman | 239/533.12 X |
| 3,958,757 | 5/1976 | Happel et al. | 239/125 |
| 4,077,374 | 3/1978 | Willmann et al. | 239/533.12 X |
| 4,197,997 | 4/1980 | Wu et al. | 239/533.12 |
| 4,230,273 | 10/1980 | Claxton et al. | 239/585 X |
| 4,258,883 | 3/1981 | Hofmann et al. | 239/124 |

FOREIGN PATENT DOCUMENTS

| | | | |
|---|---|---|---|
| 973765 | 9/1975 | Canada . | |
| 3013694 | 11/1980 | Fed. Rep. of Germany | 239/585 |
| 2088700 | 12/1971 | France . | |
| 2365070 | 4/1978 | France . | |

*Primary Examiner*—Andres Kashnikow
*Assistant Examiner*—David P. Davidson
*Attorney, Agent, or Firm*—Larson and Taylor

[57] ABSTRACT

A fuel injection valve comprises a hollow body in which there is formed a fuel circuit having an outlet opening. A guide member has a stem located in the passage and secured to the body. A bulged end portion of the guide member projects through the opening and is formed with a valve seat surface. An annular valve closure member is slidably mounted on the guide member and sealingly movable in the opening. A coil in the body is adapted to move a valve closure member into an abutment position clear from the seat. When the valve closure member is in that open position, a conical jet of fuel is delivered by the valve.

8 Claims, 1 Drawing Figure

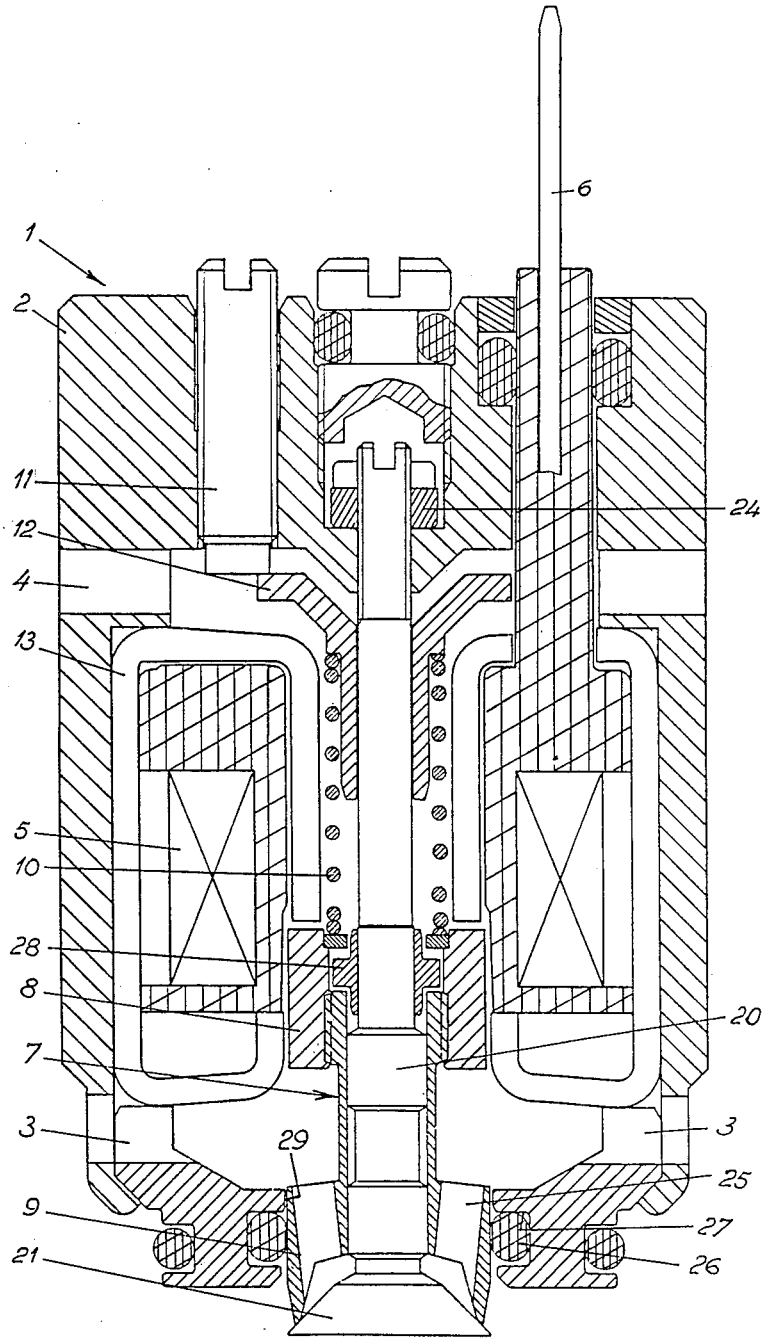
1
2
11
12
4
13
5
10
28
8
7
3
9
21
6
24
20
3
29
25
27
26

INJECTION VALVE FOR AN INTERNAL COMBUSTION ENGINE

BACKGROUND AND SUMMARY OF THE INVENTION

The invention relates to fuel injection valves for internal combustion engines, of the type comprising a hollow body defining a circuit for fuel under pressure communicating with the outside through a passage bounded by a valve seat and comprising a closure member movable in the body between a position of abutment against the valve seat, towards which it is spring biased, and a position for which the valve is open, determined by a fixed stop, towards which it is pulled by a winding located in the body when the winding is energized.

The invention is of particular, although not exclusive interest, in fuel supplying systems of the type called "monopoint" injection comprising one or several valves opening into the air intake of the engine. In these valves, fuel is injected under moderate pressure, very much less than the pressure required for direct introduction into the combustion chambers of the engine.

Many valves of the above-defined type are already known. In most cases, the valve seat, fast with the body, defines a central aperture and the fuel injection passage is bounded by this seat and a needle placed along the axis of the seat. At rest, a spring applies the needle onto the seat. When the winding is energized, pressurized fuel is delivered in the form of a jet which divides into droplets. However, particularly when injection is at low pressure, the size of the droplets and their distribution in the airflow are difficult to adjust with accuracy.

Attempts have been made to obtain better results by providing the needle with a downwardly flared frustoconical end portion, opening outwards. It is thus expected to achieve fuel distribution in the air passage as a flat conical jet, more favorable to good distribution than a concentrated jet. While at first glance that solution may be thought as simple as that involving an opening inward movement, it presents in fact various drawbacks. The operation is reversed as compared with regular valves; the needle must project through the seat opening, which complicates valve assembling; the pressure exerted by the fuel tends to open the valve, whence an increased risk of leakage of fuel.

It is an object of the invention to provide an improved injection valve of the above-defined type; it is a more specific object to provide an injection valve delivering a highly flared conical jet without however raising difficulties of mechanical construction.

For that purpose, there is provided an injection valve whose closure member is carried by an annular part slidably received on a fixed axial guide whose outward end portion is enlarged and has a flared surface acting as a valve seat.

The annular part is formed with ports for fuel flow from inside the valve body toward the flared surface and toward the gap which appears between the closure member and the seat when the closure member is lifted from the seat upon energization of the winding.

The annular part may comprise a core or plate of ferromagnetic material positioned so as to be subjected to the action of the magnetic field of the control winding.

It would seem, at first sight, that this solution is to be rejected, due to the fact that it requires the insertion, between the body and the closure member, of a sliding seal. In fact, that drawback has proven non existent and it has been found that the fluid-tight seal could withstand a very large number of openings and closing without premature wear. That favorable result is probably due to the very short strokee of the closure member: the movements of small amplitude of the closure member do not result into a sliding movement on the seal but is taken by deformation of the latter, at least when the seal has a sufficient freedom of movement; that condition is fulfilled when the seal is a O-ring housed in a groove of sufficient axial development of the body.

The invention will be better understood on reading the following description of a valve for use in a "monopoint" injection system for a combustion engine, which constitutes a particular embodiment of the invention given by way of example only.

SHORT DESCRIPTION OF THE DRAWING

The single FIGURE shows a valve according to the invention in section along a plane passing through its axis, the various elements being shown in their rest positions, when the winding is de-energized.

DETAILED DESCRIPTION OF AN EMBODIMENT

Referring to the FIGURE, a valve 1 comprises a hollow body 2 consisting of several assembled parts, defining a fuel flow circuit from one or more inlet passages 3 to one or more outlet passages 4. The body is generally provided with means (not shown) enabling it to be sealingly secured through the wall of an engine element, such as an intake manifold.

The body has an electrically insulating casing, containing an annular winding 5, through which an electrical current may be circulated from a contact lug 6 to ground lead (not shown). This winding is located on an armature of magnetic material 13 which cooperates with a core 8 belonging to a movable assembly 7 of the valve 1. The movable assembly 7 comprises, in addition to the ferromagnetic core 8, a closure member 9.

The movable assembly is tubular in shape. It encircles and is slidably received on a fixed central guide 20, secured to the body 2. In the illustrated embodiment, the guide 20 comprises a terminal portion threadedly received in the body for adjustment purpose. A clamping nut 24 is provided to lock the guide after adjustment of its position. The end portion of the guide 20 opposite that which is fixed to the body projects out of the body through a passage 29 thereof and is flared to provide a conical support surface as a seat for the closure member 9.

The movable unit can slide on guide 20 between two abutment positions. It is shown in the FIGURE in the first abutment position, or closed position, where the closure member 9 is supported on the seat formed on the flared end portion 21. The movable part is urged into this position by a return spring 10 positioned around the guide. In the embodiment illustrated, the compression force exerted by the spring 10 is adjustable by means of an adjusting pin 11 forcefitted into the casing and fixing the position of a support cup 12 for the spring. The second abutment position (open position) is determined by the abutment of a radial surface of the movable assembly against a fixed stop, constituted, in the embodiment illustrated, by a ring 28 pressed onto guide 20. The core 8 is placed in the magnetic circuit of the winding 5 so as to draw the movable assembly in the second abutment position when the winding is energized.

The closure member 9 then defines, with the seat, an annular fuel outlet.

To ensure fluid tightness between the body and the outer end portion of the closure member, a groove 27 is formed in an inwardly facing surface of passage 29 and receives a O-ring seal 26 contacting the outer surface of the closure member.

The fuel flows into the annular outlet through holes 25 formed in the closure member and whose flow cross-sectional area may be selected at will since it will always remain very much greater than that offered to the fuel in the passage between the closure member and the flared end portion.

It is unnecessary to give a complete description of operation, since it results directly from the structure of the valve. When the winding receives a PWM control signal with a duty ratio which may be very variable, the closure member reciprocates between the open and closed positions. Its stroke will always be very small, of the order of magnitude of a tenth of a millimeter, so that it will not cause sliding of the closure member on the O-ring seal 26, but deformation only. The inertia of the movable part can be very low, which is a favorable factor. The flared shape of the end portion and the accurate centering of the closure member with respect to the terminal portion, guaranted by the considerable guiding length of the movable portion on the guide 20, enable a very divergent jet of fuel to be provided, having a regular angular distribution, providing good distribution of fuel into the air traversing the manifold.

I claim:

1. A fuel injection valve for internal combustion engine, comprising: a hollow body defining a fuel circuit adapted for connection with a source of fuel under pressure and having a passage opening outside of said body; a guide member of elongated shape located in said circuit, having a first end which is securely connected to said body inside said body and an other end portion which is enlarged and projects out of said body through said passage without contact with said body, said enlarged end portion being formed with a flaring valve seat surface; an annular valve closure member sealingly slidably mounted on said guide member for movement along said guide member; spring means arranged for biasing said annular valve closure member into sealing abutment against said flaring valve seat surface; electromagnetic coil means in said body for moving said annular valve closure member into an abutment position against the action of said spring means upon energization thereof, said annular valve closure member defining, with and around said valve seat surface, an annular outlet for delivery of fuel as a conical jet.

2. A fuel injection valve according to claim 1, wherein said annular valve closure member is fast with a ferromagnetic material element so located as to be subjected to a magnetic field upon energization of said electromagnetic coil means.

3. A fuel injection valve according to claim 1, wherein said annular valve closure member has a stroke whose order of magnitude is about one tenth of a millimeter between said abutment position and said position of sealing abutment against said seat surface.

4. A fuel injection valve for internal combustion engine, comprising: a hollow body defining a fuel circuit adapted for connection with a source of fuel under pressure and having a passage opening outside of said body; a guide member located in said circuit, directed along an axis of said passage and having a first end which is securely connected to said body inside said body and an other end portion which is enlarged and projects out of said body through said passage, said enlarged end portion being formed with a flaring valve seat surface; an annular valve closure member encircling said guide member and sealingly slidably mounted on said guide member for movement along said axis; spring means arranged for biasing said annular valve member into sealing abutment against said seat surface; electromagnetic coil means in said body for moving said annular valve closure member along said axis into an abutment position against the action of said spring means upon energization thereof, said annular valve closure member defining with said valve seat surface an annular outlet when in said abutment position, the shape of said valve seat being such as to distribute fuel as a conical jet having a large angular opening.

5. A fuel injection valve according to claim 4, further comprising a deformable seal retained in a groove of said body and in sealing contact with said annular valve closure member.

6. A fuel injection valve according to claim 5, wherein said seal is a O-ring.

7. A fuel injection valve according to claim 4, wherein said annular valve closure member is formed with fuel ports for communicating a space within said body and a space communicating with said annular outlet, said ports being dimensioned for having a flow cross-sectional area much in excess of the flow cross-sectional area of said outlet when said annular valve closure member is in said abutment position.

8. A fuel injection valve for internal combustion engine, comprising: a hollow body defining a fuel circuit adapted for connection with a source of fuel under pressure and having a passage opening outside of said body; a guide member of elongated shape located in said circuit, having a first end which is securely connected to said body inside said body and an other end portion which is enlarged and projects out of said body through said passage without contact with said body, said enlarged end portion being formed with a flaring valve seat surface; a tubular movable assembly having a portion slidably received on said guide member and an annular choke valve closure member shaped for cooperating with said flaring valve seal surface; spring means arranged for biasing said tubular movable assembly for movement along said guide movement in a direction causing abutment of said annular valve closure member and said flaring valve seat surface; electromagnetic coil means in said body for moving said annular valve closure member into an abutment position against the action of said spring means upon energization thereof, said annular valve closure member defining, with and around said valve seat surface, an annular outlet for delivery of fuel as a conical jet; and seal means carried by a surface of said body defining said passage and sealingly contacting said annular valve closure member.

* * * * *